US009250050B2

(12) United States Patent
Nuetzman et al.

(10) Patent No.: US 9,250,050 B2
(45) Date of Patent: Feb. 2, 2016

(54) APPARATUS, SYSTEM, AND METHOD FOR AMMUNITION CARTRIDGE CASE ANNEALING

(71) Applicant: Setpoint Systems, Inc., Ogden, UT (US)

(72) Inventors: Steven E. Nuetzman, Syracuse, UT (US); Justin D. Carroll, Clearfield, UT (US); Robert H. Lundgreen, Jr., West Haven, UT (US); Nathan J. Morris, Ogden, UT (US); Warren L. Westphal, Roy, UT (US)

(73) Assignee: SETPOINT SYSTEMS, INC., Ogden, UT (US)

( * ) Notice: Subject to any disclaimer, the term of this patent is extended or adjusted under 35 U.S.C. 154(b) by 587 days.

(21) Appl. No.: 13/657,622

(22) Filed: Oct. 22, 2012

(65) Prior Publication Data

US 2013/0119050 A1 May 16, 2013

Related U.S. Application Data

(60) Provisional application No. 61/550,249, filed on Oct. 21, 2011.

(51) Int. Cl.

| | |
|---|---|
| ***H05B 6/02*** | (2006.01) |
| ***H05B 6/10*** | (2006.01) |
| ***F42B 33/00*** | (2006.01) |
| ***F42B 5/28*** | (2006.01) |
| ***F42B 33/14*** | (2006.01) |

(52) U.S. Cl.
CPC . *F42B 33/00* (2013.01); *F42B 5/28* (2013.01); *F42B 33/14* (2013.01)

(58) Field of Classification Search
CPC ..... F42B 33/00; F42B 33/14; F42B 5/28; H05B 6/10; H05B 6/14; H05B 6/36; H05B 6/38; H05B 6/40
USPC ..... 219/600–608, 635–637, 612; 86/33–41
See application file for complete search history.

(56) References Cited

U.S. PATENT DOCUMENTS

| | | | | |
|---|---|---|---|---|
| 2,223,970 | A | | 12/1940 | Stansel |
| 2,303,408 | A | | 12/1942 | Soderholm |
| 2,356,236 | A | | 8/1944 | Gagne, Jr. |
| 2,387,698 | A | | 10/1945 | Yost |
| 2,430,005 | A | | 11/1947 | Denneen et al. |
| 2,439,517 | A | | 4/1948 | Johnson |
| 2,907,858 | A | | 10/1959 | Distler |
| 3,005,894 | A | | 10/1961 | Carbo et al. |
| 3,110,793 | A | * | 11/1963 | Worthington ..... 219/615 |
| 3,156,011 | A | | 11/1964 | Olson |
| 3,502,840 | A | * | 3/1970 | Balakiu et al. ..... 219/608 |
| 3,829,650 | A | | 8/1974 | Armstrong |

(Continued)

*Primary Examiner* — Sang Y Paik
(74) *Attorney, Agent, or Firm* — Kunzler Law Group

(57) ABSTRACT

An apparatus, system, and method are disclosed for annealing an ammunition cartridge that include an inductive coil, the inductive coil substantially encompassing the sides of an annealing chamber, the inductive coil including a first portion comprising a first diameter and a second portion comprising a second diameter, wherein the first diameter is larger than the second diameter. Apparatus, system and method may also include an insert, the insert encompassing the sides of the annealing chamber, and a cartridge case that is unevenly heated such that the cartridge case obtains at least a first hardness at a first location and a second hardness at a second location, the first hardness different from the second hardness.

22 Claims, 8 Drawing Sheets

(56) References Cited

U.S. PATENT DOCUMENTS

| | | | | | |
|---|---|---|---|---|---|
| 4,090,698 | A | | 5/1978 | Mucha et al. | |
| 4,117,539 | A | | 9/1978 | Bell et al. | |
| 4,433,226 | A | * | 2/1984 | Wagar | 219/639 |
| 4,593,598 | A | | 6/1986 | Gunder | |
| 4,633,720 | A | | 1/1987 | Dybel et al. | |
| 4,693,109 | A | | 9/1987 | Connor et al. | |
| 4,723,472 | A | | 2/1988 | Lee | |
| 4,819,476 | A | | 4/1989 | Bakermans et al. | |
| 4,878,434 | A | * | 11/1989 | Sommet | 102/514 |
| 4,923,066 | A | | 5/1990 | Ophir et al. | |
| 4,987,528 | A | | 1/1991 | O'Brien | |
| 5,048,162 | A | | 9/1991 | Nelson | |
| 5,079,986 | A | | 1/1992 | Lee | |
| 5,299,463 | A | | 4/1994 | Gross | |
| 5,315,752 | A | | 5/1994 | Ohta et al. | |
| 5,423,199 | A | | 6/1995 | Mangrulkar | |
| 5,493,888 | A | | 2/1996 | Merkle et al. | |
| 5,564,298 | A | | 10/1996 | DeMeo | |
| 5,635,661 | A | | 6/1997 | Tuftee | |
| 5,661,656 | A | | 8/1997 | Goldman | |
| 5,715,721 | A | | 2/1998 | Anders et al. | |
| 5,941,111 | A | | 8/1999 | Skala et al. | |
| 6,122,565 | A | | 9/2000 | Wenning et al. | |
| 6,177,662 | B1 | | 1/2001 | Rutledge | |
| 6,192,561 | B1 | | 2/2001 | Bennett | |
| 6,261,082 | B1 | | 7/2001 | Han | |
| 6,311,597 | B1 | | 11/2001 | Schroth et al. | |
| 6,397,718 | B2 | | 6/2002 | Jaamison et al. | |
| 6,467,356 | B1 | | 10/2002 | Schoch | |
| 6,484,106 | B1 | | 11/2002 | Schoch | |
| 6,530,256 | B1 | | 3/2003 | Irie et al. | |
| 6,535,825 | B1 | | 3/2003 | Okano | |
| 6,619,088 | B1 | | 9/2003 | Oyamada et al. | |
| 6,620,374 | B2 | | 9/2003 | Stefanac et al. | |
| 7,024,978 | B1 | | 4/2006 | Helinski | |
| 7,073,364 | B2 | | 7/2006 | Krish, Sr. et al. | |
| 7,112,049 | B2 | | 9/2006 | Fueller et al. | |
| 7,114,365 | B2 | | 10/2006 | Rooney et al. | |
| 7,854,188 | B1 | | 12/2010 | Buckley | |
| 2006/0016524 | A1 | | 1/2006 | Scharch | |
| 2011/0094279 | A1 | | 4/2011 | Suzuki et al. | |
| 2012/0145288 | A1 | * | 6/2012 | Stratford | 148/565 |

* cited by examiner

APPARATUS, SYSTEM, AND METHOD FOR AMMUNITION CARTRIDGE CASE ANNEALING

CROSS-REFERENCES TO RELATED APPLICATIONS

This application claims the benefit of U.S. Provisional Patent Application No. 61/550,249 entitled "Apparatus, System, and Method for Ammunition Cartridge Case Annealing" and filed on Oct. 21, 2011 for Nuetzman, et. al., which is incorporated herein by reference.

FIELD

This disclosure relates to ammunition cartridge case manufacturing and more particularly relates to annealing an ammunition cartridge case.

BACKGROUND

Heating a metal object is often desired to change properties of the metal object. For example, heating a metal object may help to harden a metal, soften a metal, and/or reduce material stress within a metal. These various types of heat treatments are often referred to as annealing.

One particular metal object that is often heat treated is a cartridge case. Cartridge cases are generally processed in a mass manner. That is, each step of forming or preparing a cartridge case for use in an ammunition round is often performed substantially simultaneously on a large number of cartridge cases. For example, in cartridge case annealing processes a number of cartridge cases are often heated in an oven at the same time. After a step, such as an anneal step, the cartridge cases may be dumped into large bins for transfer to a separate location for the next step or process.

SUMMARY

From the foregoing discussion, it should be apparent that a need exists for an apparatus, system, and method for annealing cartridge casings during manufacture. Beneficially, such an apparatus, system, and method efficiently provide controllable heating to cartridge blanks.

The subject matter of the present application has been developed in response to the present state of the art, and in particular, in response to the problems and needs in the art that have not yet been fully solved by currently available cartridge manufacturing processes. Accordingly, the present disclosure has been developed to provide an apparatus, system, and method for annealing metal cartridges that overcome many or all of the above-discussed shortcomings in the art.

The subject matter of the present disclosure relates to a method for heating a cartridge case blank, the method including receiving a single cartridge case at a time in a first direction into an annealing chamber through a first opening, passing an alternating current through an inductive coil for a certain time period to heat the cartridge case, and releasing the cartridge case from the annealing chamber in the first direction through a second opening. The method may include a cartridge case that is unevenly heated such that the cartridge case obtains at least a first hardness at a first location and a second hardness at a second location, the first hardness different from the second hardness.

The method may further include receiving and passing the cartridge in a substantially downward vertical direction. In one implementation the method may include passing the alternating current through the inductive coil for a certain time period and the certain time period may be less than about two seconds. In another example, the certain time period may be between about 500 milliseconds and 800 milliseconds.

According to one implementation of the method, passing an alternating current through an inductive coil includes balancing a plurality of factors to get a desired gradient, the plurality of factors including two or more of an amplitude of the current, a wave shape of the current, a frequency of the current, an overall length of a signal, the geometry of the cartridge case, a size of the larger diameter portion, a size of the smaller diameter portion, and a diameter of tubing that forms the inductive coil. The method may also include an inductive coil that comprises a larger diameter portion and a smaller diameter portion. The method may further include monitoring the temperature of the cartridge case.

The present disclosure also relates to an apparatus for annealing an ammunition cartridge, the apparatus including an inductive coil, the inductive coil substantially encompassing the sides of an annealing chamber, the inductive coil including a first portion comprising a first diameter and a second portion comprising a second diameter, wherein the first diameter is larger than the second diameter. The apparatus may also include an insert, the insert encompassing the sides of the annealing chamber. In one embodiment, the insert is constructed of a non-conductive or non-magnetic material.

The apparatus may also include a casing enclosing and supporting the inductive coil. The casing, according to one embodiment, is constructed of a non-conductive or non-magnetic material. The annealing chamber may include a first opening and a second opening, wherein a cartridge case is allowed to pass into the annealing chamber through the first opening and out of the annealing chamber through the second opening. The apparatus may also include a release mechanism at the second opening of the annealing chamber.

Also included in the present application is a description of a system for forming an ammunition cartridge casing, the system including an annealing module configured to heat a cartridge case, a feeder module configured to feed a cartridge case into the annealing module in a controlled orientation, and a transfer module that receives the cartridge case from the annealing module, wherein the annealing module and the transfer module are configured to maintain controlled orientation of the cartridge case. The system may also include an inductive coil and a coil insert, the insert encompassing the sides of an annealing chamber.

Reference throughout this specification to features, advantages, or similar language does not imply that all of the features and advantages that may be realized with the present disclosure should be or are in any single embodiment of the disclosure. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure.

These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment.

Furthermore, the described features, structures, or characteristics of the disclosure may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
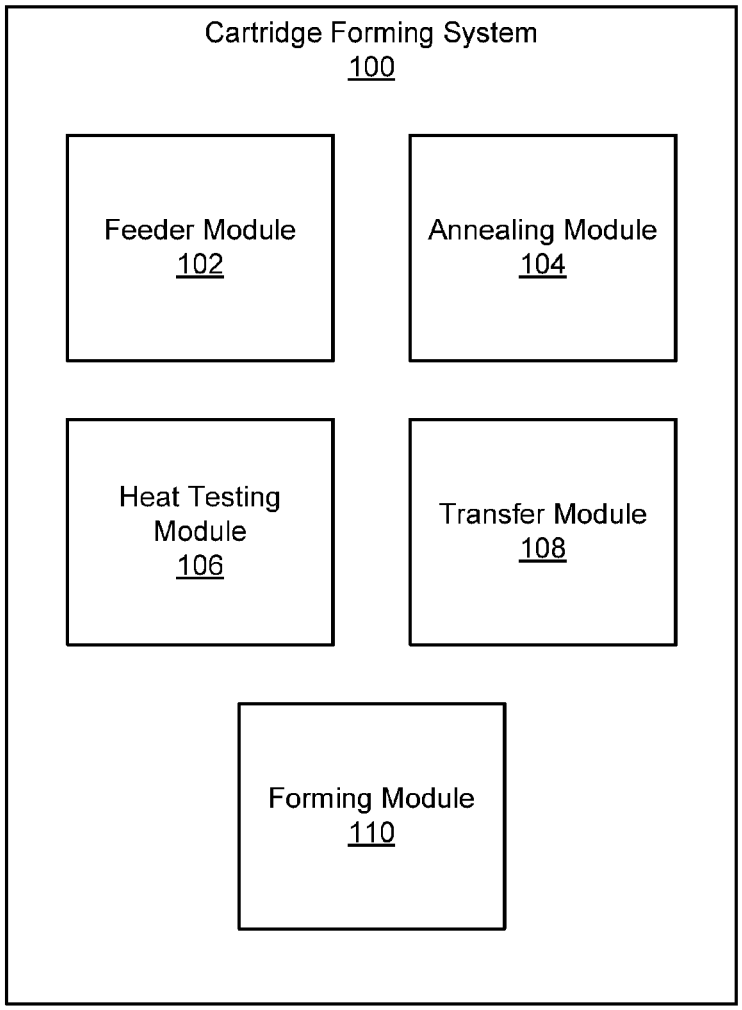
FIG. 1 is a schematic block diagram illustrating one embodiment of a cartridge forming system in accordance with the present disclosure.

FIG. 1 is a schematic block diagram illustrating one embodiment of a cartridge forming system 100. In one embodiment, the cartridge forming system 100 may perform one or more steps on a metallic cartridge case blank to form an ammunition cartridge case. According to one embodiment, the cartridge forming system 100 may perform one or more annealing, testing, and forming steps.

Figure 2:
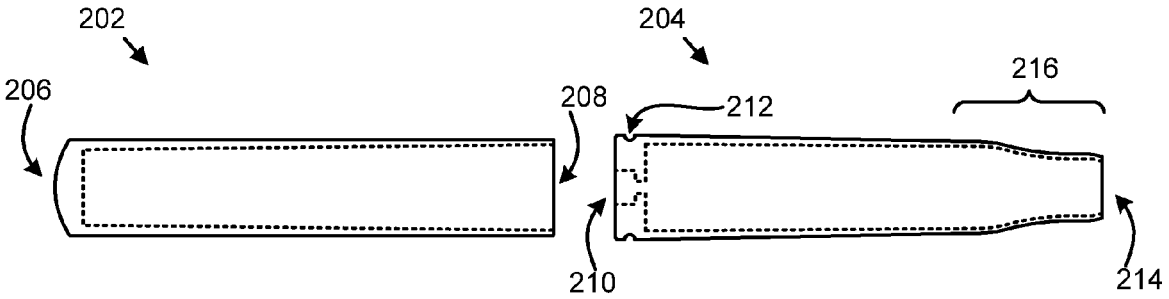
FIG. 2 is a cross-sectional side view of one embodiment of a cartridge case blank and a formed cartridge case in accordance with the present disclosure.

FIG. 2 illustrates one embodiment of a cartridge case blank 202 and a formed cartridge case 204. Solid lines indicate an outside profile of the blank 202 and the case 204 while dotted lines indicate internal dimensions along a cross section. According to one embodiment, a cartridge case blank 202 may be provided into the cartridge forming system 100 which then performs one or more steps in the process of creating the formed cartridge case 204. In one embodiment, the cartridge case blank 202 and the formed cartridge case 204 comprise brass.

In one embodiment, the cartridge case blank 202 has a tubular shape with closed end 206 and an open end 208. In one embodiment, the cartridge forming system 100 may perform one or more steps or operations to form the cartridge case 204 from the cartridge case blank 202. A formed cartridge case 204 may include a primer pocket 210 with a vent hole, an extractor groove 212, an open end 214, and a narrowed neck 216 at the open end 214. As will be understood by one skilled in the art the depicted cartridge case blank 202 and formed cartridge case 204 are exemplary only. The dimensions and features of the cartridge case blank 202 and the formed cartridge case 204 can vary considerably and are provided for illustrative purposes only.

Returning to FIG. 1, the cartridge forming system 100 may perform one or more steps in a process of forming the cartridge case 204 from the cartridge case blank 202. In one embodiment, the cartridge forming system 100 may only perform one of a plurality of steps in forming the cartridge case 204. In one embodiment, the cartridge forming system 100 may perform substantially all steps in forming the cartridge case 204 from the cartridge case blank 202.

As used herein the terms cartridge case, cartridge casing, or case are given to mean a cartridge case blank, a formed cartridge case, or a cartridge case at any stage after one or more steps have been performed on the cartridge case blank 202. It will be understood by one skilled in the art that as one or more steps are performed on a cartridge case it may still not be a finished cartridge case and may not properly be called either a cartridge case blank or a formed cartridge case. For this reason, the terms cartridge case, cartridge casing, and case should be interpreted broadly as referring to the metal material at any point along the process of forming a finished cartridge case.

In one embodiment, the cartridge forming system 100 includes a feeder module 102, an annealing module 104, a testing module 106, a transfer module 108, and a forming module 110. The modules 102-110 are exemplary only and may not all be included in all embodiments. In fact, some embodiments may include one or more of the modules 102-110 in any combination without limitation.

The cartridge forming system 100 may include a feeder module 102. In one embodiment, the feeder module 102 feeds a cartridge case into an annealing module 104. In one embodiment, the feeder module 102 may feed a cartridge case into the annealing module 104 in a controlled orientation. For example, the feeder module 102 may receive a cartridge case in a random orientation and may orient the cartridge case into a predefined orientation. In one embodiment, the feeder module 102 may receive a cartridge case in a controlled orientation and maintain a controlled orientation as the cartridge case is fed into the annealing module.

In one embodiment, the feeder module 102 may feed a single cartridge case at a time into the annealing module 104. In one embodiment, the feeder module 102 may feed cartridge cases one at a time upon some interval, such as a predefined interval or a variable interval. In one embodiment, the feeder module 102 feeds a cartridge case into the annealing module 104 upon receiving a command to feed an additional cartridge case. In one embodiment, the feeder module 102 may include a collator, tube, release mechanism, and/or a plurality of other mechanisms for feeding a cartridge case into the feeder module.

The cartridge forming system 100 may include an annealing module 104. The annealing module 104 may heat a cartridge case. In one embodiment, a single cartridge case may be heated at a time. In one embodiment, a cartridge case may be heated to obtain a desired hardness or softness, reduce stress within the material of the cartridge case, and/or create a substantially similar starting point for cartridge cases in preparation for one or more forming steps. In one embodiment, the cartridge case is heated to create a desired uniform or nonuniform hardness within the material of a cartridge case. Further discussion and detail of the annealing module 104 will be provided in relation to additional figures.

The cartridge forming system 100 may include a heat testing module 106. The heat testing module 106 may test the temperature of a cartridge case heated by the annealing module 104. In one embodiment, the heat testing module 106 may verify that the cartridge case was heated to a desired temperature. The heat testing module 106 may test for a desired heat gradient and/or may record temperatures to track any variations of heating between cartridge cases. The heat testing module 106 may include a non-contact heat testing device or mechanism. For example, the heat testing module may include a non-contact thermometer such as a non-contact laser thermometer.

The heat testing module 106 may perform a heat test at any point within the cartridge forming system 100 or at any stage within a process performed by the cartridge forming system 100. In one embodiment, the heat testing module 106 performs a heat test while a cartridge case is still within or being held by the annealing module 104. In one embodiment, the heat testing module 106 may test the heat of a cartridge case after the cartridge case has left the annealing module 104. For example, the heat testing module 106 may perform a heat test when the annealing module 104 releases a cartridge case and/or after a transfer module 108 receives a cartridge case.

The cartridge forming system 100 may include a transfer module 108. In one embodiment, the transfer module 108 may include one or more mechanisms or devices for transferring a cartridge case from the annealing module 104 to a forming module 110. In one embodiment, the transfer module 108 may transfer a cartridge case to some other device or mechanism.

In one embodiment, the transfer module 108 may maintain a cartridge case in a controlled orientation. According to one embodiment, the transfer module 108 may receive a cartridge case in a controlled orientation and may maintain the controller orientation during transfer to a forming module 110.

In one embodiment, the transfer module 108 may include a cooling station for allowing a cartridge case to cool. In one embodiment, the transfer module 108 may allow a cartridge casing to cool until it reaches a dimensionally stable temperature. For example, if a cartridge case is extremely hot it may have different dimensions than if the cartridge case were at room temperature or even fairly close to room temperature. Additionally, a cartridge case may have significantly different hardness or softness at different temperatures. In one embodiment, allowing a cartridge case to cool allows it to hit a temperature where it will have more consistent material characteristics. This may be important for consistency in forming a plurality of cartridge cases.

In one embodiment, a cooling station may include a cooling rack upon which one or more cartridge cases may be placed. For example, a plurality of cartridge cases may be on the cooling rack at any one time. As a cartridge case is released from the annealing module 104 and placed on the cooling rack another cartridge case may be removed from the cooling rack and transferred to a forming module 110. In one embodiment, the cartridge cases may be air cooled.

The cartridge forming system 100 may include a forming module 110. The forming module 110 may perform one or more forming steps that shape a cartridge case. In one embodiment, the forming module 110 may include one or more presses, die, and/or other forming mechanisms. In one embodiment, the forming module 110 may perform one or more of a head stamp, a head punch, and a neck forming press.

According to one embodiment, the cartridge forming system maintains a controlled orientation of a cartridge case from the time it is fed into the annealing module 104 to the time it is transferred to the forming module 110. In one embodiment, maintaining a controlled orientation means maintaining a cartridge case in substantially the same orientation although it may be moved laterally and/or vertically. In one embodiment, maintaining a controlled orientation means maintain control of the orientation of the cartridge case, even if the orientation and/or position of the cartridge case may be altered. For example, in one embodiment, a cartridge case is maintained in a controlled orientation even though it is horizontal at one time or vertical at another time as long as the change in orientation is controlled by one or more modules or mechanisms of the cartridge forming system 100

Figure 3:
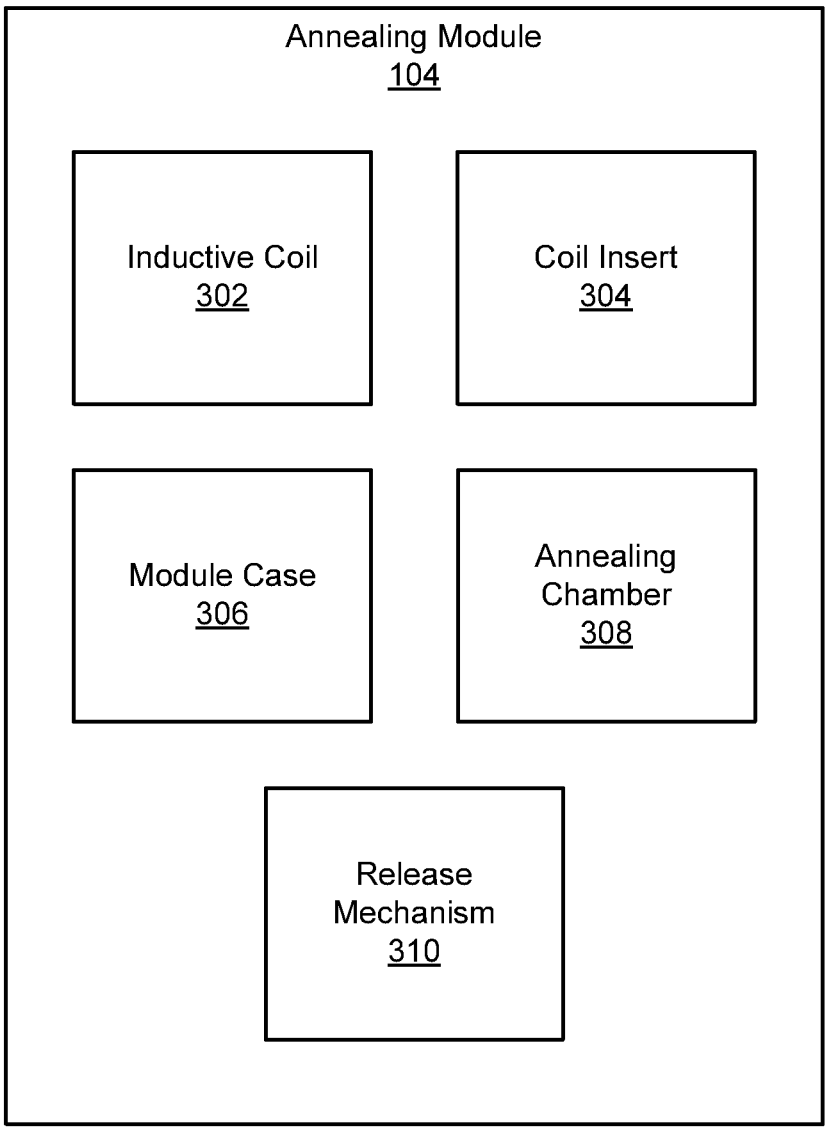
FIG. 3 is a schematic block diagram illustrating one embodiment of an annealing module in accordance with the present disclosure.

Turning to FIG. 3 a schematic block diagram illustrating exemplary components and features of an annealing module 104 is illustrated. As previously mentioned, the annealing module 104 may be used to heat a cartridge case to obtain a desired hardness or softness, reduce stress within the material of the cartridge case, and/or create a substantially similar starting point for materials in cartridge cases in preparation for one or more forming steps. In one embodiment, the annealing module 104 may create a substantially uniform hardness of a cartridge case. In one embodiment, the annealing module 104 creates a nonuniform hardness in a cartridge case. For example, a cartridge case may be heated such that it has two different hardness's at two different points. A cartridge case may be heated such that it has a hardness grating that varies along the length of a cartridge case, from one end to the other.

In one embodiment, the annealing module 104 may receive a cartridge case in a first direction and release the cartridge case and allow it to continue along in the first direction. In one embodiment, the annealing module 104 may include a through hole chamber that allows a cartridge case to be receive through one opening and release the case through a second opening. According to one embodiment, this may allow for quick and controlled entry and release of a cartridge case. It may also allow for controlled orientation following the heating of a cartridge case. Exemplary components, features, and configurations of the annealing module 104 will now be discussed.

In the depicted embodiment of FIG. 3, the annealing module 104 includes an inductive coil 302, a coil insert 304, a module case 306, an annealing chamber 308, and a release mechanism 310. The components and features 302-310 are exemplary only and may not be included. In varying embodiments, one or more of the components and features 302-310 in any combination may be included in an annealing module 104.

The annealing module 104 may include an inductive coil 302 for heating a cartridge case. In one embodiment, the inductive coil may be energized with electrical power to create a changing magnetic field. The changing magnetic field may then induce currents within a conductive or magnetic material such as a cartridge case placed in the magnetic field. Induced currents and other effects may then cause heat to be generated within the conductive or magnetic material.

Figure 4A:
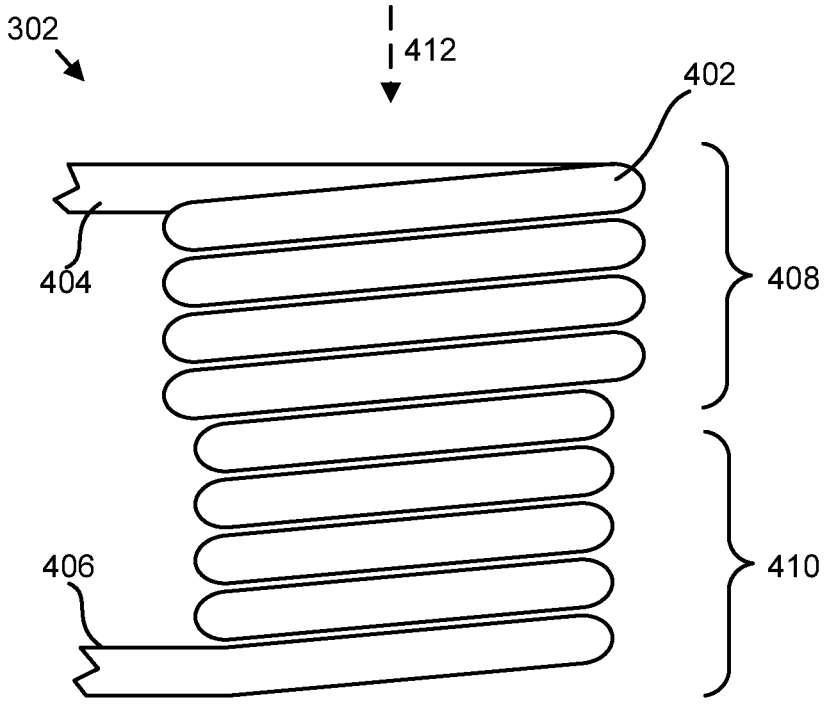
FIGS. 4A and 4B illustrate top and side views of one embodiment of an inductive coil in accordance with the present disclosure.
Figure 4B:
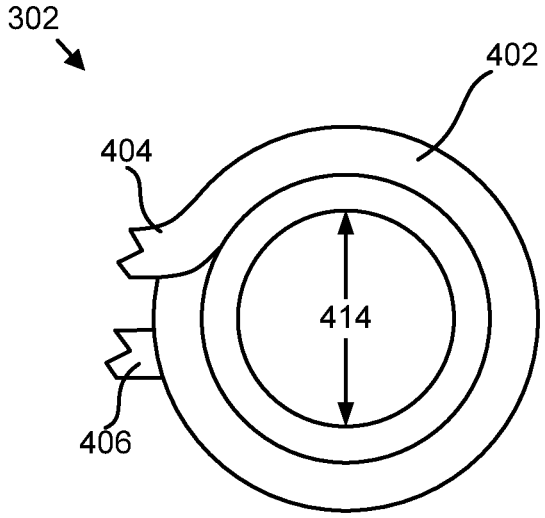

FIGS. 4A and 4B illustrate one embodiment of an inductive coil 302 for heating a cartridge case. FIG. 4A is a side view of one embodiment of an inductive coil 302. The inductive coil 302 may be formed of a tubing 402 having ends 404 and 406. In one embodiment, the tubing 402 is formed of copper or some other conductive metal. The conductive tubing 402 may be wound into a helical shape having a large diameter portion 408 and a small diameter portion 410. FIG. 4B is a top view of the inductive coil 302 of FIG. 4A from the direction indicated by line 412. FIG. 4B illustrates a smallest internal diameter 414. According to one embodiment, the smallest internal diameter 414 may be large enough for the largest portion of a cartridge case to pass through.

In one embodiment, the inductive coil 302 may be formed by winding, bending, and/or shaping tubing 402 into a helical shape. In one embodiment, a mandrel may be used as a guide for shaping the tubing 402.

According to one embodiment, the ends 404, 406 of the coil may be connected to a power source. The power source may be used to provide an electrical signal through the tubing 402 in order to heat an object within the inductive coil's 302 interior diameter. In one embodiment, an electrical signal through the tubing 402 may induce a large amount of heat in the tubing 402 of the inductive coil 302 itself. In one embodiment, a coolant may be circulated through the tubing to keep the coil 302 from getting excessively heated or damaged. The coolant may include any coolant known in the art including water or an oil.

A number of factors may influence how an object within the inductive coil 302 is heated. How an object is heated may influence how hard different portions of the object may be following heating. According to one embodiment, variations in the signal may affect how quickly an item will be heated and/or how hot the item can ultimately get. One factor may include the amplitude of an electrical signal. For example, an electrical signal with a higher power will create a stronger magnetic field and result in greater heat generation. Another factor may include a wave shape of the electric signal. For example, a square wave may induce a higher intensity magnetic field than a sinusoidal or triangular wave. Another factor may include a frequency of the electric signal. Higher frequency signals may cause a more rapidly cycling magnetic field which may induce greater heat creation within a given time.

Yet another factor may be the overall length of the signal. The longer a signal is applied to the coil the greater the amount of time during which heat is generated in a cartridge case in the coil. This may lead to a higher temperature than if the signal length was shorter. Additionally, the overall length of the signal may also impact how uniform an object or cartridge case is heated. For example, a longer signal time may allow for heat to more evenly dissipate throughout a cartridge while a shorter signal time may keep heat localized. In some embodiments, shorter signal times may be desirable to obtain a hardness gradient within the cartridge case. In one embodiment, the overall length of the signal is very short. In one embodiment, the length of the signal is less than two seconds. In one embodiment, the length of the signal is less than one second. In one embodiment, the length of the signal is between about 500 and 800 milliseconds. In one embodiment, length of the signal is about 600 milliseconds.

In one embodiment, variations in geometry of both the inductive coil 302 and a cartridge case may also affect how quickly a cartridge case is heated or how hot the cartridge case can get. Variations in geometry of both the inductive coil 302 and a cartridge case may also affect how uniformly or non-uniformly a cartridge case within the coil is heated.

In one embodiment, a diameter of the tubing 402 that is used to form the coil 302 may affect how much current the coil 302 can handle as well as how smooth an induced magnetic field may be. For example, tubing 402 having a larger diameter may have a lower impedance and may allow for a higher current without excessive losses of heat within the coil 302 itself. On the other hand, tubing 402 having smaller diameters may create a more smooth or uniform magnetic field. A smoother or more uniform magnetic field may allow for a more controlled and predictable heating of a cartridge case.

In one embodiment, a diameter of an inductive coil 302 may affect how a cartridge case is heated. For example, a smaller diameter may induce a more intense magnetic field thorough the coil given the same amount of current. This more intense magnetic field my then induce greater currents within a cartridge casing and lead to greater heat generation. Larger diameters may have a less intense magnetic field. In one embodiment, an inductive coil 302 may be a stepped coil, like the coil 302 of FIGS. 4A and 4B. That is the inductive coil 302 has a plurality of diameters within the same coil 302. In one embodiment, one portion of the coil (such as the smaller diameter 410) will generate a larger amount of heat than another portion (such as the larger diameter 408), assuming an cartridge case with uniform diameter. In one embodiment, an object having a nonuniform diameter within a stepped coil may have approximately equal amounts of heat generated at all locations.

Additional factors that may affect how a cartridge case is heated may include the material of the cartridge case and the structure of the cartridge case. According to one embodiment, portions of a cartridge case having greater mass may require greater amounts of heat to be generated to create the same temperature as in a less massive portion. For example, in the closed end 206 of the cartridge case blank 202 of FIG. 2 has more mass than the open end 208. In one embodiment, the closed end 206 may be oriented such that it is within the inductive coil 302 on the smaller diameter 210 end of the coil.

Figure 5A:
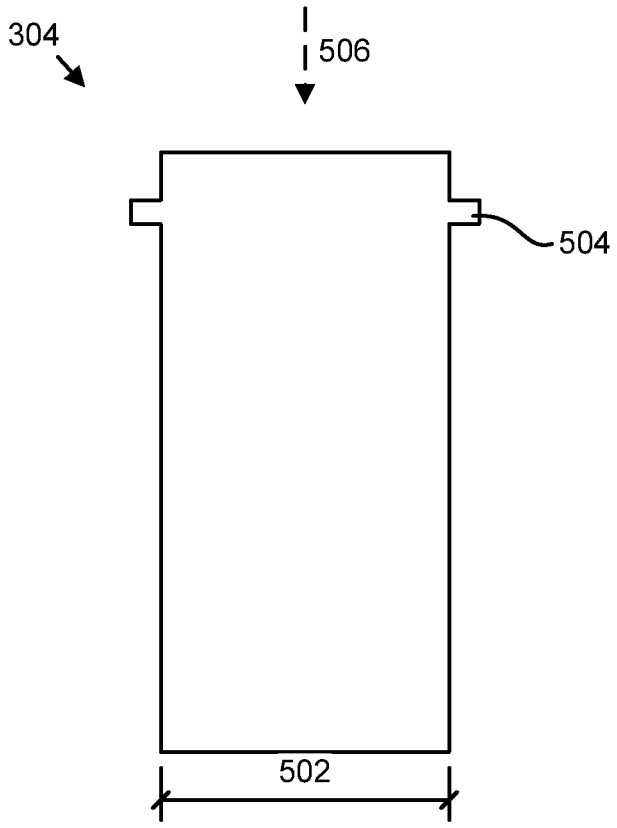
FIGS. 5A and 5B illustrate top and side views of one embodiment of a coil insert in accordance with the present disclosure.
Figure 5B:
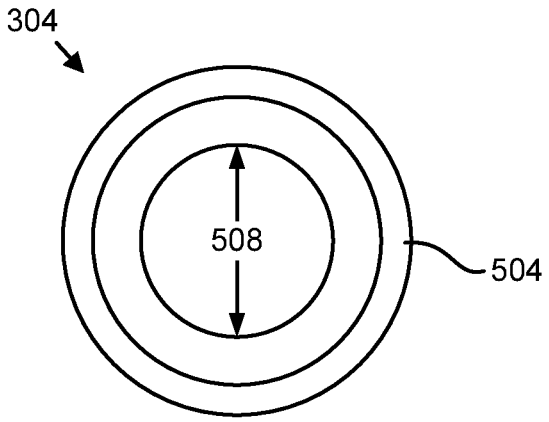

Returning to FIG. 3 an annealing module 104 may also include a coil insert 304. In one embodiment, the coil insert 304 may be inserted into the inductive coil 302. FIGS. 5A and 5B illustrate one embodiment of a coil insert 304. FIG. 5A is a side view of coil insert 304 depicting an outside diameter 502 and a lip 504. FIG. 5B illustrates a top view of the coil insert 304 along the line 506 and illustrates an inside diameter 508. In one embodiment, the coil insert 304 is configured for insertion into the inductive coil 302 of FIGS. 4A and 4B. For example, the outside diameter 502 may be small enough to allow the coil insert 304 to fit within the smallest inside diameter 414 of the inductive coil 302. In one embodiment, the lip 504 may rest on a portion of an inductive coil 302 to maintain its position with relation to the coil.

In one embodiment, the inside diameter 508 of the coil insert 304 may be large enough to allow a cartridge case to fit within the coil insert 304. In one embodiment, the inside diameter 508 defines a annealing chamber 308 such that a cartridge case may pass through the inside diameter 508 of the coil insert 304. In one embodiment, the inside diameter 508 substantially matches an outside diameter of a cartridge case. For example, the inside diameter 508 may be large enough for a cartridge case to slide through the coil insert 304 but may also be small enough for each successive cartridge case to be supported in substantially the same position.

In one embodiment, the coil insert 304 is formed of a nonconductive material and/or a nonmagnetic material. In one embodiment, the coil insert 304 is formed of a ceramic. For a ceramic free of conductive or magnetic particles may be used. In one embodiment, the coil insert 304 may be formed of any nonconductive and non magnetic material. In one embodiment, a coil insert 304 formed of a nonconductive and nonmagnetic material may allow for magnetic waves induced by the inductive coil 302 to pass through the coil insert 304 with little or no interaction with the material of the coil insert.

The coil insert 403 may keep a cartridge casing from contacting the inductive coil 302. For example, without a coil insert 304 there may be risk of a cartridge casing contacting portions of the inductive coil 302 and causing a short which would reduce the magnetic field and/or reduce the amount of uniform heating that can be created through an induced magnetic field. Additionally, collision between a cartridge case and the coil 302 may result in damage to the coil. This may especially be the case in situations where larger ammunition cases are being formed. In one embodiment, the coil insert 403 decreases the likelihood of contact between the coil 302 and a cartridge case.

Figure 6:
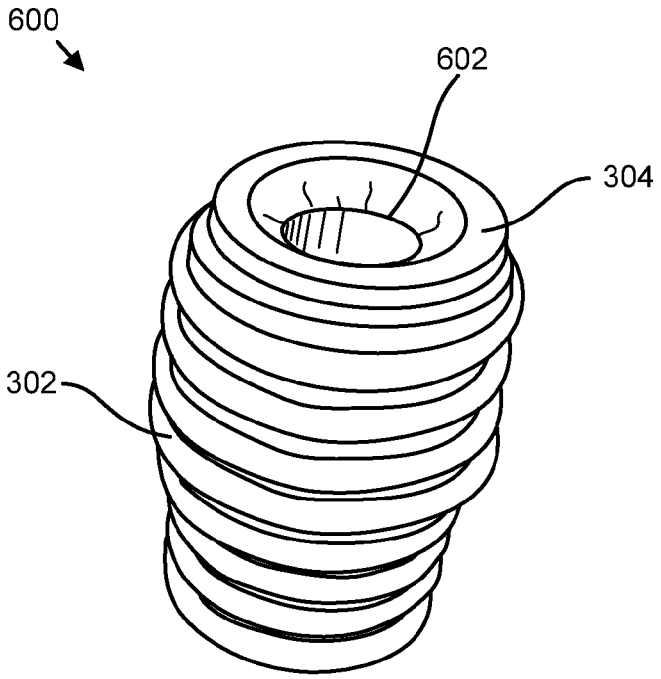
FIG. 6 illustrate one embodiment of a coil and insert assembly in accordance with the present disclosure.

FIG. 6 illustrates a coil and insert assembly 600 that includes the inductive coil 302 with an inserted coil insert 304. A cartridge case 602 is shown within the coil insert 304 and is only partially visible.

Returning to FIG. 3, an annealing module 104 may include a module case 306. In one embodiment, a module case 306 may form a semi rigid case for housing the inductive coil 302. In one embodiment, the module case 306 may protect the coil 302 from contact with other objects or with individuals. For example, due to high voltages that may flow through the inductive coil 302 it may reduce risk of electrical short or shock which may cause damage to other devices or to individuals.

Additionally, the module case 306 may provide a rigid structure that helps maintain an inductive coil 302 in substantially the same shape and/or geometry. As discussed above, the geometry of the inductive coil 302 can influence how a cartridge casing is heated. If an inductive coil must support its own weight it may sag over time and heating of cartridge casings may then also vary over time. A rigid or semi rigid module case 306 may reduce an amount of deformation of the inductive coil 302 and thus maintain a more uniform heating of cartridge casings over time.

Figure 7:
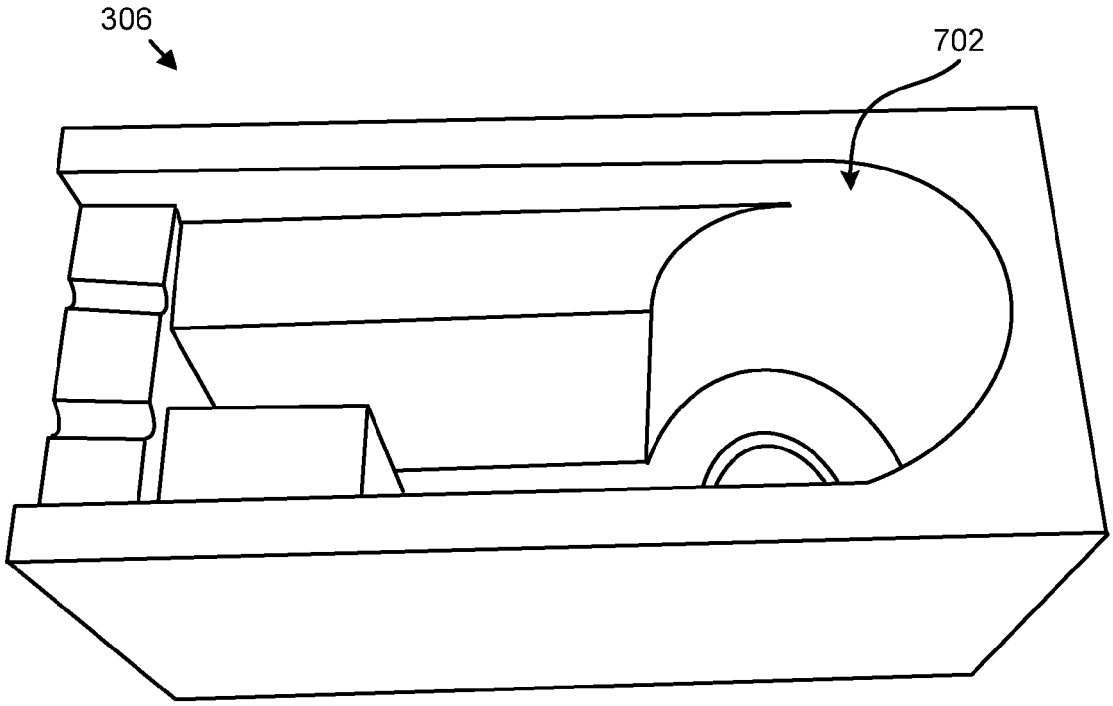
FIG. 7 is a perspective view of one embodiment of an annealing module case in accordance with the present disclosure.

FIG. 7 illustrates one embodiment of a module case 306. The module case 306 includes a coil cavity 702 for receiving an inductive coil 302. For example, the coil and insert assembly 600 of FIG. 6 may be inserted into the coil cavity 702. The geometry of the module case 306 is exemplary only.

In one embodiment, the module case 306 may be formed of a nonconductive and/or nonmagnetic material. In one embodiment, the module case 306 may be formed of a plastic, ceramic, plaster, rubber, Teflon, nylon or any other material. In one embodiment ends 404, 406 may be threaded out of the module case 306 and connected to a power supply and/or pump as previously discussed.

Returning again to FIG. 3 an annealing module 104 may include an annealing chamber 308. In one embodiment, the annealing chamber 308 may be where cartridge cases are placed when annealed. For example, a cartridge case may be placed in an annealing chamber 308 and then an electrical signal may be passed through an inductive coil 302 to heat the cartridge case.

In one embodiment, an annealing chamber 308 is defined by one or more of the inductive coil 302, the coil insert 304, and the module case 306. In one embodiment, the annealing chamber 308 is encircled by one or more of the inductive coil 302, the coil insert 304, and the module case 306. In one embodiment, the bounds of the annealing chamber 308 are defined by the inside diameter 508 of the coil insert 304. For example, the cartridge case 602 of FIG. 6 within the coil and insert assembly 600 is shown within one embodiment of a through hole chamber.

In one embodiment, the annealing chamber 308 may be of a size to closely match a geometry of a cartridge case. For example, the annealing chamber 308 may be shaped to accommodate only a single cartridge case at a time. This may allow each cartridge case to be heated in a uniform matter. For example, with an annealing chamber 308 that closely corresponds to the geometry of a cartridge case each cartridge case may be in substantially same position in relation to a heating coil. This may reduce the amount of variation between heating of cartridge cases.

Additionally, heating a single coil at a time may allow for closed loop feedback for heating cartridge cases. For example, while a cartridge case is being heated the a temperature of a cartridge case may be measured. The cartridge case may be heated until a desired temperature level is reached.

Even without closed loop control, by heating a single cartridge case at a time and measuring its temperature slight changes and variations in how cartridge cases are being heated can be noticed. For example, if there is a trend that cartridge cases temperatures are slowly dropping in temperature one or more factors, such as a signal duration or wave shape, can be varied to obtain a desired temperature. Thus, variations in temperatures of cartridge cases can be noticed and remedied before any cartridge case fails. Heating and testing of a single cartridge case may allow for the accommodation of ambient temperatures changes or changes in cartridge cases. Heating and testing of a single cartridge case may significantly limit the amount of wasted material or time that may when cartridge cases begin to fail being properly heated and/or formed.

In one embodiment, a chamber 308 may be a through-hole chamber. For example, the chamber 308 may allow a cartridge case to be placed within an annealing chamber 308 through one opening and released from the annealing chamber 308 through another opening. In one embodiment, an annealing chamber 308 may include a vertically oriented with an opening at the top and an opening at the bottom. In one embodiment, a feeder module 102 may feed a cartridge case into the annealing chamber 308 from above that allows the cartridge case to move downward into the chamber. The cartridge case may be retained within the chamber during and anneal and then released to move downward out of the chamber. In one embodiment, allowing a cartridge chamber to be released downward out of the chamber instead of upward from the direction in which it was fed may reduce the amount of time required to remove the cartridge case and feed a next cartridge case into the chamber. In one embodiment, a vertically oriented through-hole chamber may allow for greater simplicity in an annealing step and reduce the chance of errors or failure. In one embodiment, gravity may facilitate movement of a cartridge case through the annealing module.

The annealing module may include a release mechanism 310. In one embodiment, the release mechanism 310 may allow a cartridge case to be released from the annealing module 104. In one embodiment, the release mechanism may simply allow a cartridge casing to drop out a bottom of an annealing module 104 due to gravity. In one embodiment, some assistance may be provided by the release mechanism 310 to provide a force to move the cartridge case from the chamber. For example, the release mechanism 310 may provide forced air or any other mechanism that applies a force to the cartridge case to move it out of the annealing module 104.

Figure 8:
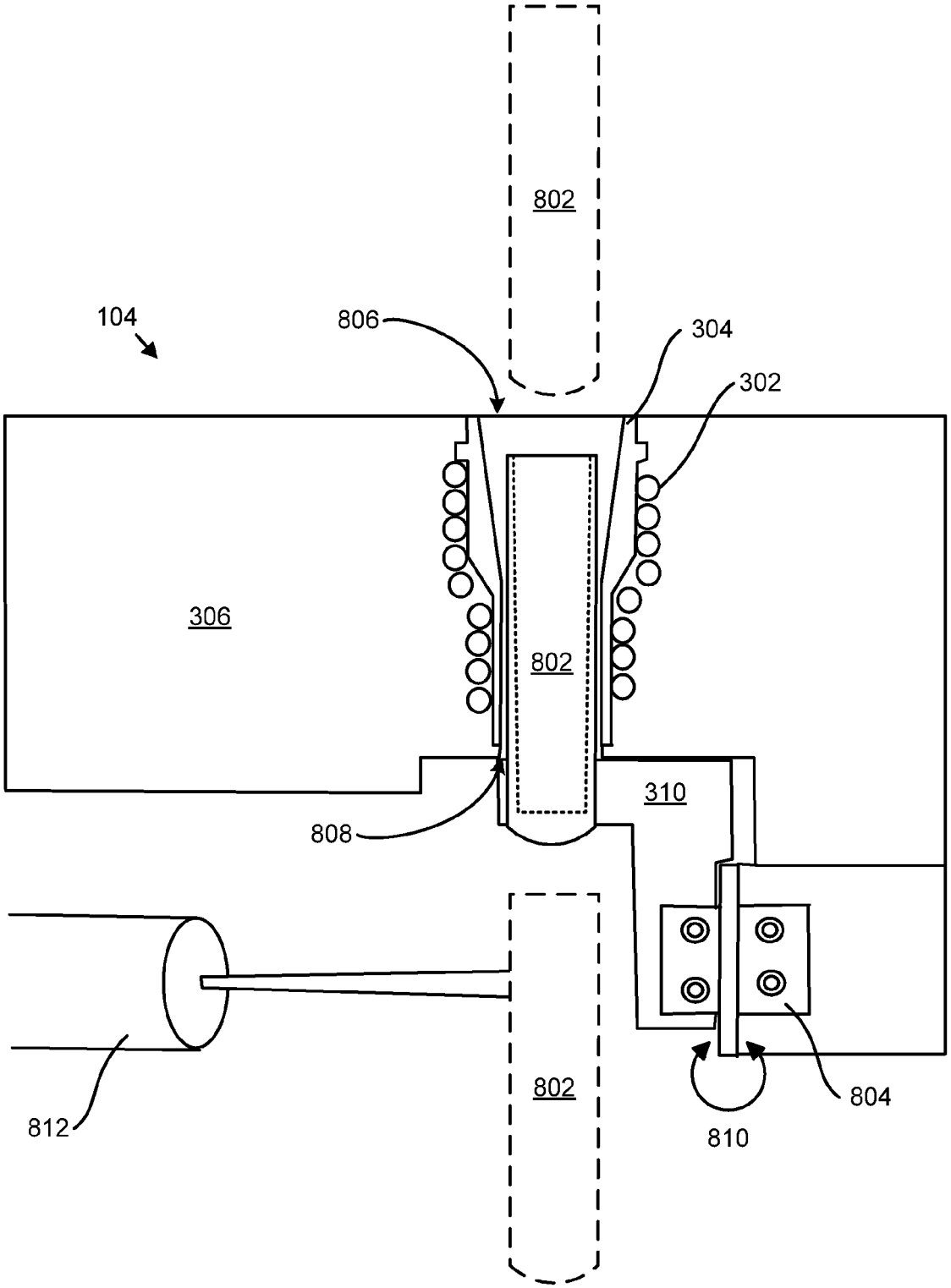
FIG. 8 is a cross sectional side view of an annealing module illustrating exemplary movement of a cartridge case through the annealing module.

FIG. 8 is a cross sectional side view of an annealing module 104 illustrating exemplary movement of a cartridge case 802 through the annealing module 104. FIG. 8 depicts an annealing module 104 and a cartridge case 802 at different positions. The annealing module 104 is depicted including an inductive coil 302, a coil insert 304, and a module case 306, each of which may include any of the variations previously discussed. The annealing module 104 is also depicted including a release mechanism 310.

In the depicted embodiment, the cartridge case 802 is shown at three positions in relation to the annealing module 104. The cartridge case 802, at one position, is above the annealing module 104. According to one embodiment, the cartridge case 802 is fed from this position above the annealing module 104 into the coil insert 304 through a first opening 806. In one embodiment, the cartridge case 802 is fed by a feeder module 104, which is not shown. In one embodiment, the cartridge case 802 is fed by allowing gravity to pull the cartridge case 802 into the annealing module 104. In one embodiment, forced air may be used to move the cartridge case 802 into the annealing module 104.

The cartridge case 802 is also shown within the annealing module 104. In one embodiment, the cartridge case 802 may remain within the annealing module 104 for a period of time to heat the cartridge case. In one embodiment, the cartridge case 802 remains within the annealing module 802 for less than three seconds. In one embodiment, the cartridge case 802 may remain within the annealing module 802 for less than two seconds. According to one embodiment, a position of the cartridge case 802 in relation to the inductive coil 302 may be adjusted. For example, a height of the cartridge case 802 in relation to the inductive coil 302 may be adjusted. For example, the release mechanism 310 may be moved up or down in relation to the inductive coil 302 to adjust the height of the cartridge case 802 in relation to the coil 302.

The position of the cartridge case 802 within the coil 302 illustrates the geometry of the coil 302 in relation to the mass of the cartridge case 802. In one embodiment, the cartridge case 802 is illustrated in a position in relation to the coil 302 in which the cartridge case 802 would be heated. For example, the lower portion of the inductive coil 302 has a smaller diameter than the upper portion. According to one embodiment, more heat will be generated in the lower or middle portion of the cartridge case 802. This may be desirable because there is greater mass in the lower portion, or capped end, of the cartridge case 802, as illustrated. In one embodiment, the cartridge case 802 may be heated to a uniform temperature. In one embodiment, the cartridge case 802 is heated to a gradient of temperatures along its length. In one embodiment, the heat to which a portion of the cartridge case 802 is heated controls a hardness at that portion of the cartridge case 802.

In one embodiment following a heating of the cartridge case, the release mechanism 310 may allow the cartridge case to drop from the annealing module 104 to a third position below the annealing module 104. In one embodiment, the release mechanism 310 may include a hinge 804 which allows the release mechanism 310 to rotate as indicated by arrows 810 to allow the cartridge case to drop from the annealing module 104. In one embodiment, the cartridge case is released through a second opening 808. In one embodiment, a transfer module 108 (not shown) may receive the cartridge case.

In one embodiment, a non-contact laser thermometer 812 may test the temperature at one or more points on the cartridge case 802. Testing the temperature may indicate whether the annealing module 104 is functioning properly and/or if any adjustments need to be made. For example, one or more factors that affect how a cartridge case is heated may be adjusted for one or more later cartridges. These factors include geometry of the coil, attributes of the electrical signal passed through the coil, etc.

Figure 9:
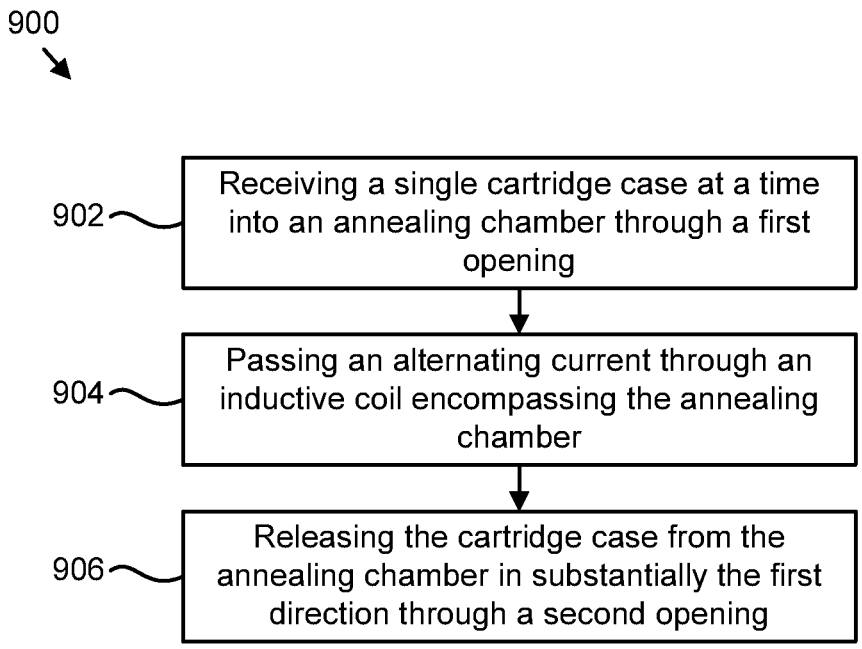
FIG. 9 is schematic flow chart diagram illustrating a method for heating a cartridge case.

FIG. 9 is schematic flow chart diagram illustrating a method 900 for heating a cartridge case. In one embodiment, the method 900 is performed by an annealing module 104. In one embodiment, the method 900 may be used to soften a cartridge case, harden a cartridge case, reduce stress within the material of a cartridge case, or any other purpose. In one embodiment, the method 900 is used prior to a cartridge case forming step.

The method 900 may include receiving 902 a cartridge case into an annealing chamber. In one embodiment, a single cartridge case is received 902. In one embodiment, the cartridge case is received into the annealing chamber through a first opening. In one embodiment, the cartridge case may be received from a feeder module 102. In one embodiment, the cartridge case is fed into the annealing chamber in a downward vertical direction. In one embodiment, the cartridge case is received in a controlled orientation.

The method 900 may include passing 904 an alternating current through an inductive coil. In one embodiment, the inductive coil encompasses the annealing chamber. The inductive coil may encompass the sides of the annealing chamber without enclosing the first opening or a second opening of the annealing chamber. In one embodiment, the inductive coil may include a stepped coil. For example, the inductive coil may include a first diameter portion and a second diameter portion that have different diameters.

Passing 904 the alternating current through the inductive coil may include passing a current having a variety of signal shapes. In one embodiment, the alternating current includes one or more of a square, a triangular, or a sinusoidal wave shape. In one embodiment, the alternating current is passed 904 through the inductive coil for less than two seconds. In one embodiment, the alternating current is passed 904 through the inductive coil for less than 800 milliseconds or 600 milliseconds. In one embodiment, the alternating current is passed 904 through the inductive coil while the cartridge case is held substantially stable in relation to the inductive coil.

The method 900 may include releasing 906 the cartridge case from the annealing chamber. In one embodiment, the cartridge case is released 906 in substantially the same direction in which the cartridge case was received 902. In one embodiment, the cartridge case is received 902 and released 906 in a substantially downward vertical direction. In one embodiment, the cartridge case is released 906 through a second opening that is different than the opening through which the cartridge case was received. In one embodiment, the cartridge case is released and gravity is allowed to pull the cartridge case from the annealing chamber in a downward direction. In one embodiment, a transfer module 108 receives the cartridge case in a controlled orientation when the cartridge case is released 906.

Figure 10:
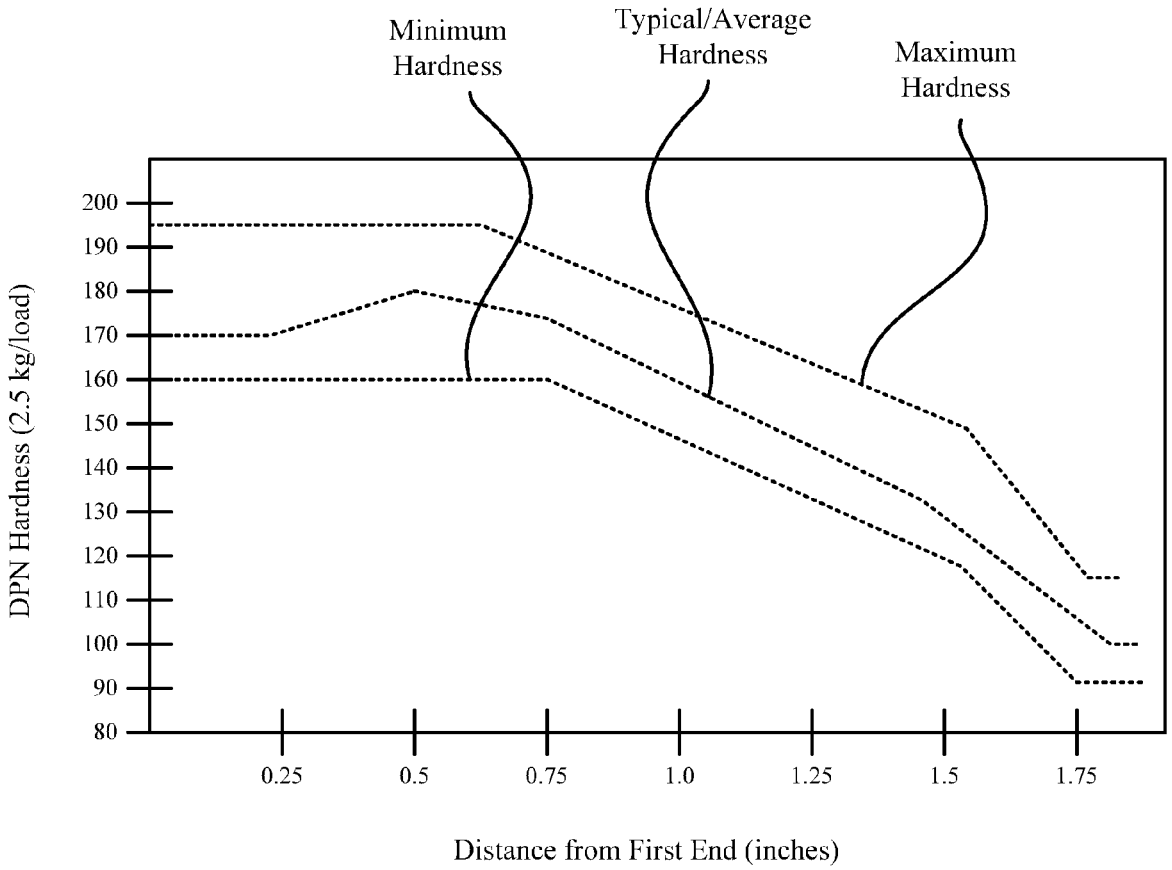
FIG. 10 is a hardness gradient chart of a cartridge case in accordance with the present disclosure.

FIG. 10 is a hardness gradient chart of a cartridge case in accordance with the present disclosure. FIG. 10 depicts three hardness gradient curves labeled "Minimum Hardness", "Typical/Average Hardness", and "Maximum Hardness". As described above, the annealing module may be used to generate at least two points along the length of the cartridge case that have different hardness ratings. The different degrees of hardness along the length of the cartridge case may provide for subsequent processing steps or may provide the requisite hardness for a certain application. As depicted and according to one embodiment, the annealing module is capable of creating cartridge cases that generally fall within a certain hardness range.

According to one embodiment, a cartridge forming system 100 may perform one or more steps or processes, such as the steps and processes discussed above, to form at least a partially finished cartridge case. In one embodiment, one or more forming, annealing, and/or other processes may be performed to create a cartridge case with the specifications shown in FIG. 10. One of skill in the art will recognize that cartridge cases of various specifications may be annealed, formed, or otherwise modified without departing from the scope of the present disclosure.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A method for heating a cartridge case blank, the method comprising:

receiving a single cartridge case at a time in a first direction into an annealing chamber through a first opening, wherein the single cartridge case engages a release mechanism proximate a second opening of the annealing chamber and a position of the single cartridge case within the annealing chamber is controlled by a position of the release mechanism;

passing an alternating current through an inductive coil for a certain time period to heat the cartridge case; and opening the release mechanism to release the cartridge case from the annealing chamber in the first direction through the second opening.

2. The method of claim 1, wherein the cartridge case is unevenly heated such that the cartridge case obtains at least a first hardness at a first location and a second hardness at a second location, the first hardness different from the second hardness.

3. The method of claim 1, wherein the first direction comprises a substantially downward vertical direction.

4. The method of claim 1, wherein the certain time period during which an alternating current is passed through the inductive coil is less than about two seconds.

5. The method of claim 1, wherein the certain time period during which an alternating current is passed through the inductive coil is between about 500 milliseconds and 800 milliseconds.

6. The method of claim 1, wherein passing an alternating current through an inductive coil comprises balancing a plurality of factors to get a desired gradient, the plurality of factors comprising two or more of an amplitude of the current, a wave shape of the current, a frequency of the current, an overall length of a signal, the geometry of the cartridge case, a size of the larger diameter portion, a size of the smaller diameter portion, and a diameter of tubing that forms the inductive coil.

7. The method of claim 1, wherein the inductive coil comprises a larger diameter portion and a smaller diameter portion.

8. The method of claim 1, further comprising monitoring the temperature of the cartridge case.

9. An apparatus for annealing an ammunition cartridge, the apparatus comprising:

an inductive coil, the inductive coil substantially encompassing the sides of an annealing chamber, the inductive coil comprising a first portion comprising a first diameter and a second portion comprising a second diameter, wherein the first diameter is larger than the second diameter, wherein the annealing chamber further comprises a first opening and a second opening; and a release mechanism proximate the second opening, wherein the release mechanism is configured to engage a single cartridge case and position the single cartridge case in a desired position within the annealing chamber, wherein the release mechanism is also configured to open to release the single cartridge case from the annealing chamber through the second opening.

10. The apparatus of claim 9, further comprising an insert, the insert encompassing the sides of the annealing chamber.

11. The apparatus of claim 10, wherein the insert is constructed of a non-conductive or non-magnetic material.

12. The apparatus of claim 9, further comprising a casing enclosing and supporting the inductive coil.

13. The apparatus of claim 12, wherein the casing is constructed of a non-conductive or non-magnetic material.

14. The apparatus of claim 9, wherein the annealing chamber comprises a first opening and a second opening, wherein a cartridge case is allowed to pass into the annealing chamber through the first opening and out of the annealing chamber through the second opening.

15. The apparatus of claim 14, further comprising a release mechanism at the second opening of the annealing chamber.

16. A system for forming an ammunition cartridge casing, the system comprising:

an annealing module configured to heat a cartridge case, wherein the annealing module comprises an annealing chamber and a release mechanism;

a feeder module configured to feed a cartridge case into the annealing chamber of the annealing module in a controlled orientation, wherein the cartridge case engages the release mechanism and the release mechanism positions the cartridge case in a desired position within the annealing chamber; and a transfer module, that receives the cartridge case from the annealing module after the release mechanism opens to release the cartridge case from the annealing module, wherein the annealing module and the transfer module are configured to maintain controlled orientation of the cartridge case.

17. The system of claim 16, the annealing module comprising an inductive coil and a coil insert, the insert encompassing the sides of the annealing chamber.

18. The system of claim 17, wherein the coil insert is constructed of a non-conductive or non-magnetic material.

19. The system of claim 17, the annealing module further comprising a casing enclosing and supporting the inductive coil.

20. The system of claim 19, wherein the casing is constructed of a non-conductive or non-magnetic material.

21. The system of claim 17, wherein the annealing chamber comprises a first opening and a second opening, wherein a cartridge case is allowed to pass into the annealing chamber through the first opening and out of the annealing chamber through the second opening.

22. The system of claim 21, further comprising the release mechanism at the second opening of the annealing chamber.

* * * * *